US011459743B2

(12) United States Patent
Gottfried

(10) Patent No.: US 11,459,743 B2
(45) Date of Patent: Oct. 4, 2022

(54) FLOOR CLEANING DEVICE

(71) Applicant: Ofer Gottfried, Batsra (IL)

(72) Inventor: Ofer Gottfried, Batsra (IL)

( * ) Notice: Subject to any disclaimer, the term of this patent is extended or adjusted under 35 U.S.C. 154(b) by 0 days.

(21) Appl. No.: 17/611,378

(22) PCT Filed: May 18, 2020

(86) PCT No.: PCT/IB2020/054694

§ 371 (c)(1),
(2) Date: Nov. 15, 2021

(87) PCT Pub. No.: WO2020/234748

PCT Pub. Date: Nov. 26, 2020

(65) Prior Publication Data

US 2022/0220718 A1 Jul. 14, 2022

Related U.S. Application Data

(60) Provisional application No. 62/849,903, filed on May 19, 2019.

(51) Int. Cl.

| | |
|---|---|
| ***E03D 13/00*** | (2006.01) |
| ***E03D 5/10*** | (2006.01) |
| ***A47L 11/24*** | (2006.01) |
| ***A47L 11/40*** | (2006.01) |
| ***E03D 9/00*** | (2006.01) |

(52) U.S. Cl.
CPC ..... *E03D 13/005* (2013.01); *E03D 5/105* (2013.01); *A47L 11/24* (2013.01); *A47L 11/4011* (2013.01); *A47L 11/4036* (2013.01); *E03D 9/00* (2013.01)

(58) Field of Classification Search
CPC ..... E03D 13/005; E03D 5/105; E03D 9/00; E03D 13/00; A47L 11/24; A47L 11/4011; A47L 11/4036; A47L 11/28; A47L 11/4008; A47L 11/4069; A47L 11/4091
See application file for complete search history.

(56) References Cited

U.S. PATENT DOCUMENTS

| | | | |
|---|---|---|---|
| 2017/0283092 | A1 | 10/2017 | Brown et al. |
| 2018/0368646 | A1 | 12/2018 | Buehler et al. |

FOREIGN PATENT DOCUMENTS

| | | |
|---|---|---|
| GB | 2549191 | 10/2017 |
| JP | 6-136800 | 5/1994 |
| JP | 8-24164 | 1/1996 |
| JP | 2005-213785 | 8/2005 |
| WO | 2013053712 | 4/2013 |

*Primary Examiner* — David Redding
(74) *Attorney, Agent, or Firm* — The Law Office of Joseph L. Felber

(57) ABSTRACT

A cleaning system for cleaning a floor of a restroom has a self-driven cleaning head. The system has in addition a docking site for at least partially housing the cleaning head when not in use, and the cleaning head is permanently connected to electrical, water cables and hydraulic and/or pneumatic hoses during use.

32 Claims, 10 Drawing Sheets

FLOOR CLEANING DEVICE

TECHNICAL FIELD

Embodiments of the invention relate to a floor cleaning device, in particular for use in a urinal or toilet environment.

BACKGROUND

In urinals that are used in a standing position, cleanliness of the floor may often be compromised. Therefore, it is common to clean the floor quite frequently in order to maintain a hygiene environment. However, maintaining a clean and hygiene environment in public urinals that are frequently used by individuals may be more difficult to accomplish. As a result, various solutions for assisting in cleaning of urinal floors have been proposed.

WO2013053712 for example describes a device for cleaning a standing surface for a urinal that includes a cassette-type insert that has a moveable standing surface for insertion in a recess in a floor below the urinal. A controllable drive device is provided for moving the standing surface past a cleaning device for cleaning the moveable standing surface.

Such solutions however are dedicated for cleaning the floor below a single urinal and require installation of a special standing mechanism, which may be costly in particular if applied in a public urinal environment that includes many urinals.

SUMMARY

The following embodiments and aspects thereof are described and illustrated in conjunction with systems, tools and methods which are meant to be exemplary and illustrative, not limiting in scope.

In an embodiment there is provided a cleaning system for cleaning a floor of a restroom and comprising a wall coupled cleaning head and a docking site.

Wall coupling of the cleaning head in at least most embodiments may be taken to refer to connection and/or wiring of the cleaning head to power, liquid, pneumatic (etc.) sources required for its function. Wall coupling of the cleaning head may be via cables, pipes, electrical wires (or the like) that provide the cleaning head with access to incoming and outgoing fluid/liquid and power required for its operation.

In certain embodiments, the cleaning head may be of a self-driving ability, which may be facilitated via a driving means such as a motor implemented within the cleaning head.

In certain cases, the cleaning head may be movable via means other or in addition to self-driving—such as via an actuator or linear actuator, possibly with an integrated motor (such as an 'actuator and motor drive' and/or a 'linear belt driven actuator' available from various manufactures such as Macron Dynamics Inc. or the like). Such actuators may be coupled to the cleaning head coupling/connecting it to a wall of a restroom and may optionally be made to move along a rail (or the like) to urge movement of the cleaning head along a floor being cleaned together with tubes, pipes and the like required for its operation.

The docking site may be arranged to at least partially house the cleaning head when not in use, wherein the cleaning head being permanently connected to electrical cables, water source and drain or the like and hydraulic and/or pneumatic hoses.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
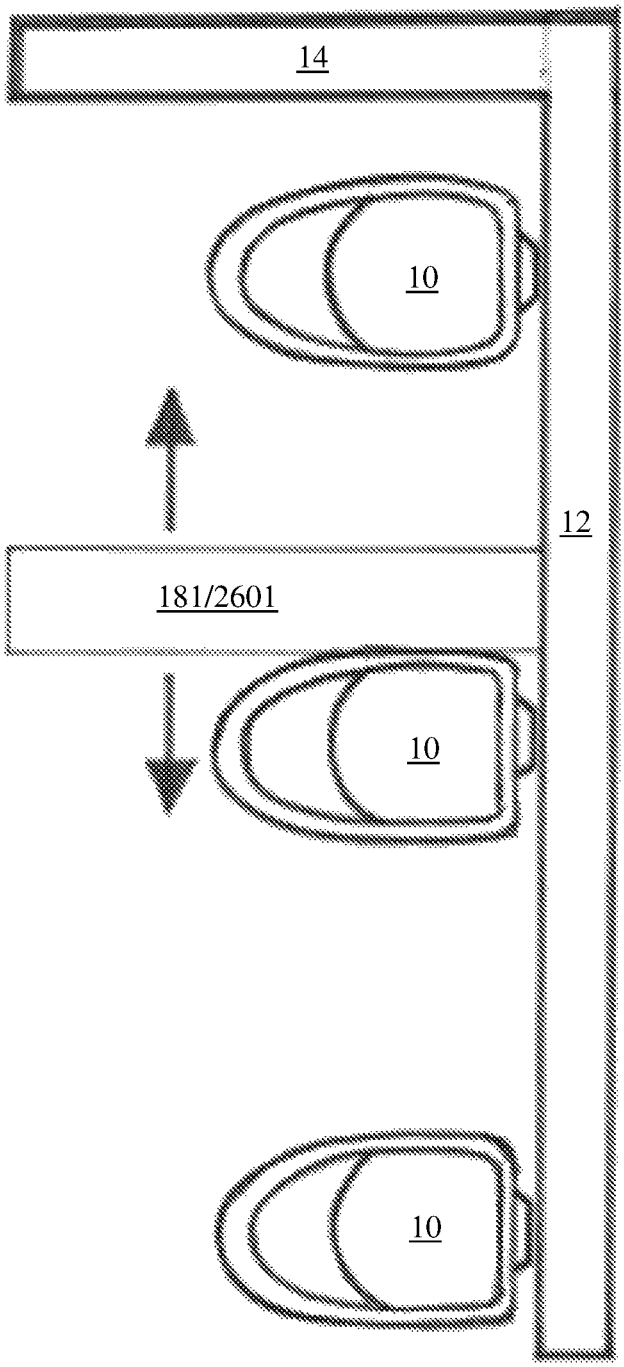
FIG. 1 schematically shows a cleaning system in accordance with an embodiment of the present invention for cleaning a floor of a urinal.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 illustrating a top view of a restroom that includes several urinals 10 that are placed in a row along a front wall 12 to which the urinals are fitted. The restroom also includes in this example a side wall 14 that extends generally perpendicular to the front wall 12 at a side or the row of urinals.

It is noted that throughout the present specification urinals may be mostly mentioned, however aspects of the present disclosure may be equally relevant to any other sanitary fixture within a restroom where cleaning may be periodically required in order to maintain a hygiene environment.

The restroom seen in this view includes an embodiment of a cleaning system 181 that is wall-coupled i.e. permanently connected to a wall of the restroom during all stages of use, possibly with assistance of a cable carrier or the like (not shown in the Fig.) for guiding and supplying a cleaning head

2601 of the system with necessary liquid, drainage, power (or the like) for its operation.

In certain embodiments the cleaning head may be of a self-driving ability for permitting the cleaning head movement back and forth along the floor of a restroom, here alongside the front wall to clean the floor below the urinals. Self-driven ability of a cleaning head may be facilitated in the various embodiments herein discussed by a driving means located within the head, such as an electric motor, that is arranged to drive the cleaning head possibly via wheels provide within the head along the floor.

Figure 3:
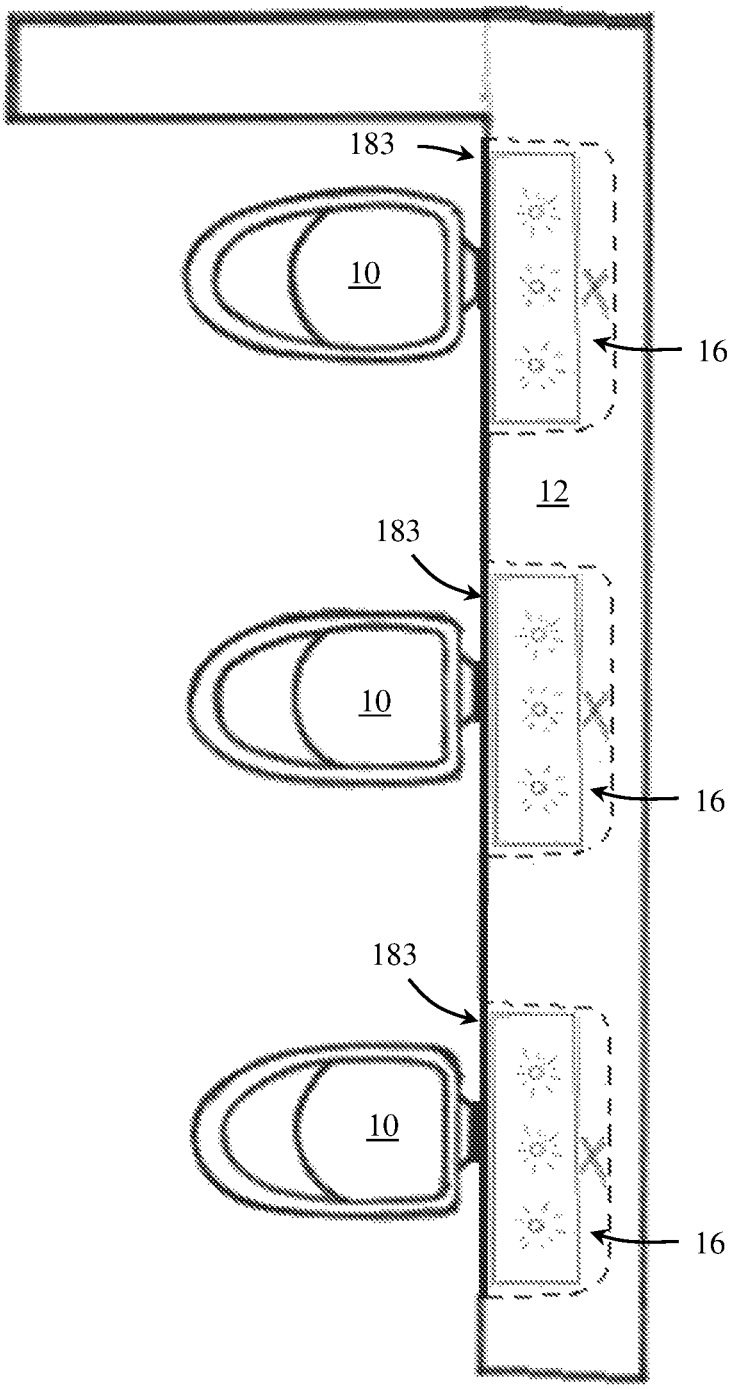
FIG. 3 schematically shows another embodiment of a cleaning system.
Figure 4:
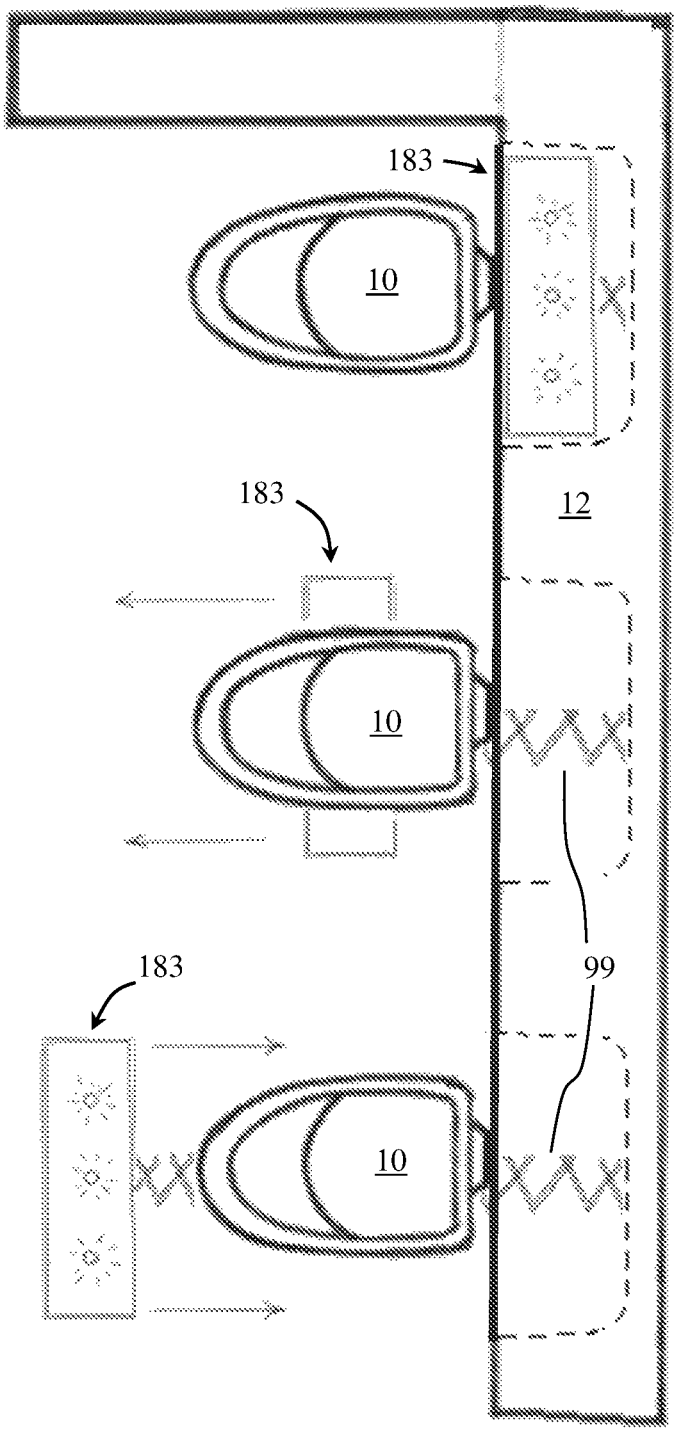
FIG. 4 schematically shows the cleaning system of FIG. 3 during operation.

In certain embodiments other possibilities may exist for moving the cleaning head along the floor. For example actuators may be coupled to a cleaning head for moving it along the floor (see, e.g., FIGS. 3 and 4 illustrating scissor type actuators urging cleaning heads away and towards a wall of the restroom and/or see FIG. 8).

Cleaning system 181 may be arranged to perform a cleaning action of the floor periodically or according to certain triggers, such as detection of liquid such as urine and/or other dirt on the floor beneath or in a vicinity of one or more of the urinals. Detection of movement e.g. or users in a vicinity of a urinal or toilet to be cleaned, may be another example of such trigger. A cleaning action by a cleaning head of such system (as in FIGS. 1, 2 and 7) may also include advancing the cleaning head to clean a certain region, e.g. beneath a certain urinal, and then 'parking' the cleaning head until demand for further cleaning is required. Such 'parking' of the cleaning head not necessarily within its docking site may limit disturbance to users of the restroom by e.g. avoiding/limiting movement of the head along the floor e.g. back to the docking site after completing a cleaning action of a certain region of the floor.

Figure 2:
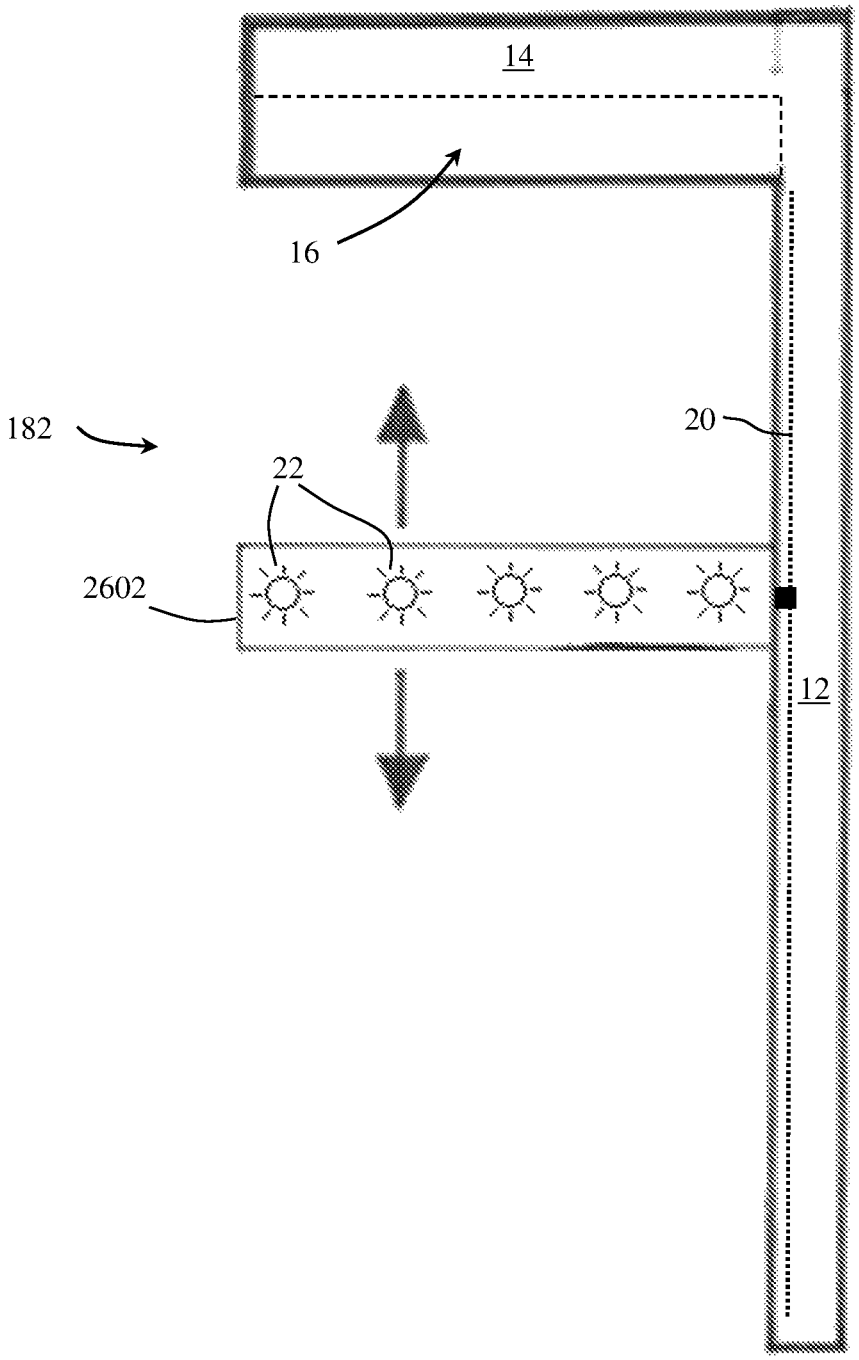
FIG. 2 schematically shows an embodiment of a cleaning system generally similar to that in FIG. 1 but with the urinals removed.

Attention is additionally drawn to FIG. 2 illustrating an embodiment of a cleaning system 182 generally similar to 181. In this figure, the urinals have been removed to provide a better view of the cleaning system and its cleaning head 2602. In at least certain embodiments, a docking site 16 of the cleaning system may be provided where the cleaning head of system 182 may be housed when idle. In this example, docking site 16 is formed as a cavity within the side wall 14 where the cleaning system's head 2602 may be at least partially stored so it does not take up substantial space on the floor when not in use.

Cleaning system 182 may include a rail 20 along which it's cleaning head may be guided to maneuver along the floor, where here rail 20 may be placed to extend along front wall 12. Rail 20 may be arranged to lead, move, support and/or guide flexible electrical cables and hydraulic and/or pneumatic hoses required for cleaning actions performed by its cleaning head (such as drainage, power and liquid supply, or the like).

Such leading, moving, supporting and/or guiding may also or alternatively be facilitated by a cable carrier (such as carrier 71 later discussed) that may be designed to extend concealed within the restroom environment, such as at least partially concealed within one of the walls of the restroom. In addition, in this example the cleaning system is seen including indicators 22 that may take form of flashing lights and/or sound indicators (or the like) for waring users of the restroom when in use.

Attention is drawn to FIG. 3 exemplifying an embodiment of a cleaning system 183, in this example several such systems 183 associated each with a respective urinal 10. Each cleaning system 183 may include a respective docking site 16 formed within the front wall 12, where each such docking site being arranged for housing the cleaning system's cleaning head when not in use. The cleaning heads may be wall-coupled i.e. connected to power, water, drain (or the like) required for their operation during their movements along the floor. The cleaning heads may be of a self-driving type or may be urged to move via actuators (see, e.g., scissor type actuators 99 indicated in FIG. 4).

Attention is drawn to FIG. 4 illustrating the cleaning systems 183 of FIG. 3 during possible cleaning operations. While the cleaning system at the upper side of this figure is seen still housed within its docking site 16, the cleaning system 183 below it in this view is seen performing a cleaning action in a direction away from the front wall and the cleaning system 183 at the bottom of this figure is seen on route back towards its docking site.

Cleaning system 183 may be arranged to provide support and/or guiding for flexible electrical cables and hydraulic and/or pneumatic hoses required for cleaning actions performed by its cleaning head (such as drainage, power and liquid supply or the like). Such support and/or guiding may also or alternatively be facilitated by a cable carrier (such as carrier 71 later discussed) that may be designed to extend towards the cleaning head of system 183 as it advances in its cleaning action.

Each cleaning system 183 may be arranged to operate independently from other cleaning systems 183 and may be suited to clean a floor region immediately beneath the urinal it is arranged to service. A possible advantage of the arrangement seen in FIGS. 3 and 4 may be that during each cleaning operation only a portion of the floor beneath the urinal being serviced may be occupied by the cleaning system thus permitting use of adjacent urinals during this time span.

Figure 5:
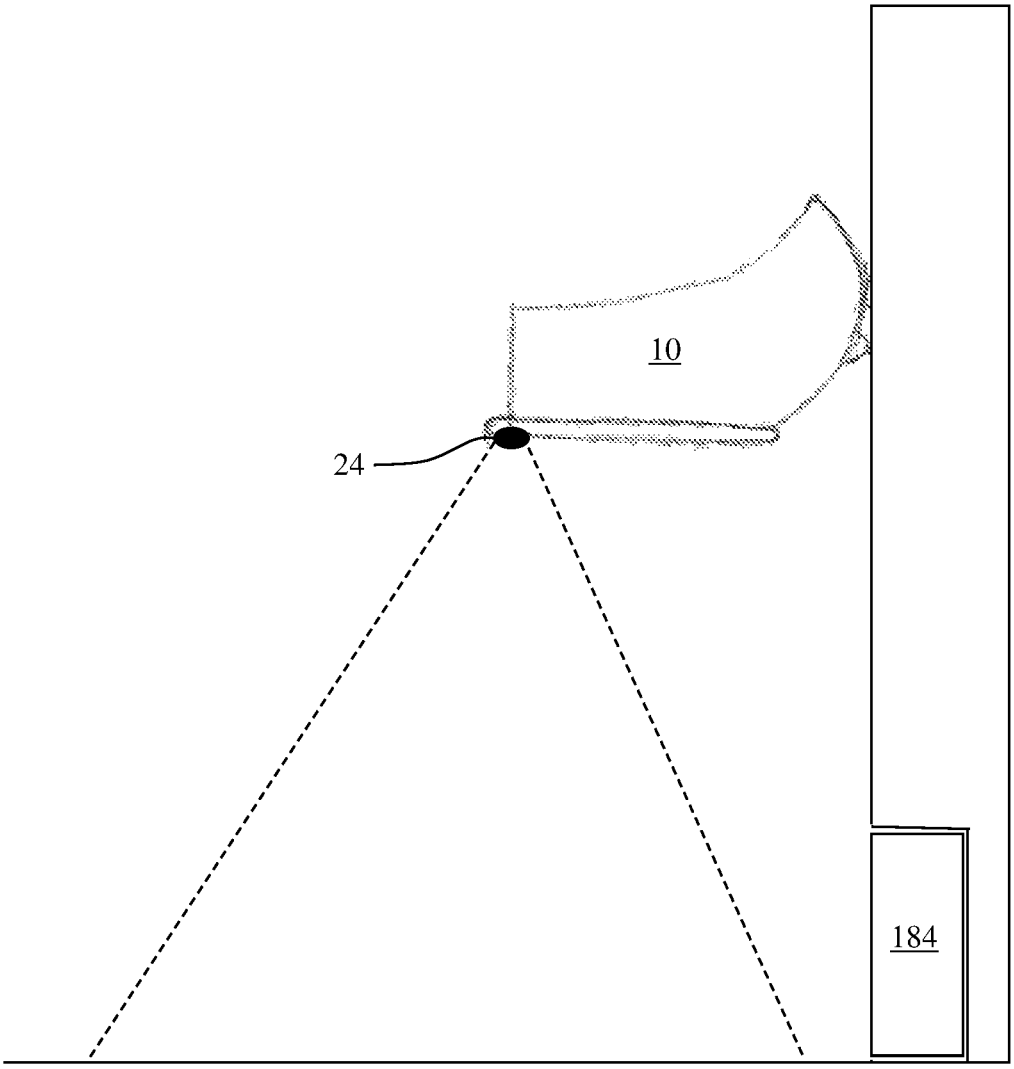
FIG. 5 schematically shows an embodiment of a cleaning system of the present invention in a side view of a urinal.

Attention is drawn to FIG. 5 illustrating a side view of a urinal 10 within a restroom. In this view an embodiment of a cleaning system 184 is seen including an optional sensor 24, possibly an optical and/or odor sensor, which is arranged to sense the floor region immediately beneath the urinal. Sensor 24 in this example is seen being fitted to the lower side of the urinal, however any other location suitable for permitting sensing of the floor may be chosen. For example, such sensor may be fitted to the cleaning head (see, e.g. sensors 262 in FIG. 6).

Upon detection of urine, movement or other substances at a certain floor region, a controller of the cleaning system (not shown) in communication with the sensor may be arranged to trigger a cleaning operation of the floor region by cleaning system 184 that may be generally similar to any one of the embodiments disclosed herein.

Figure 6:
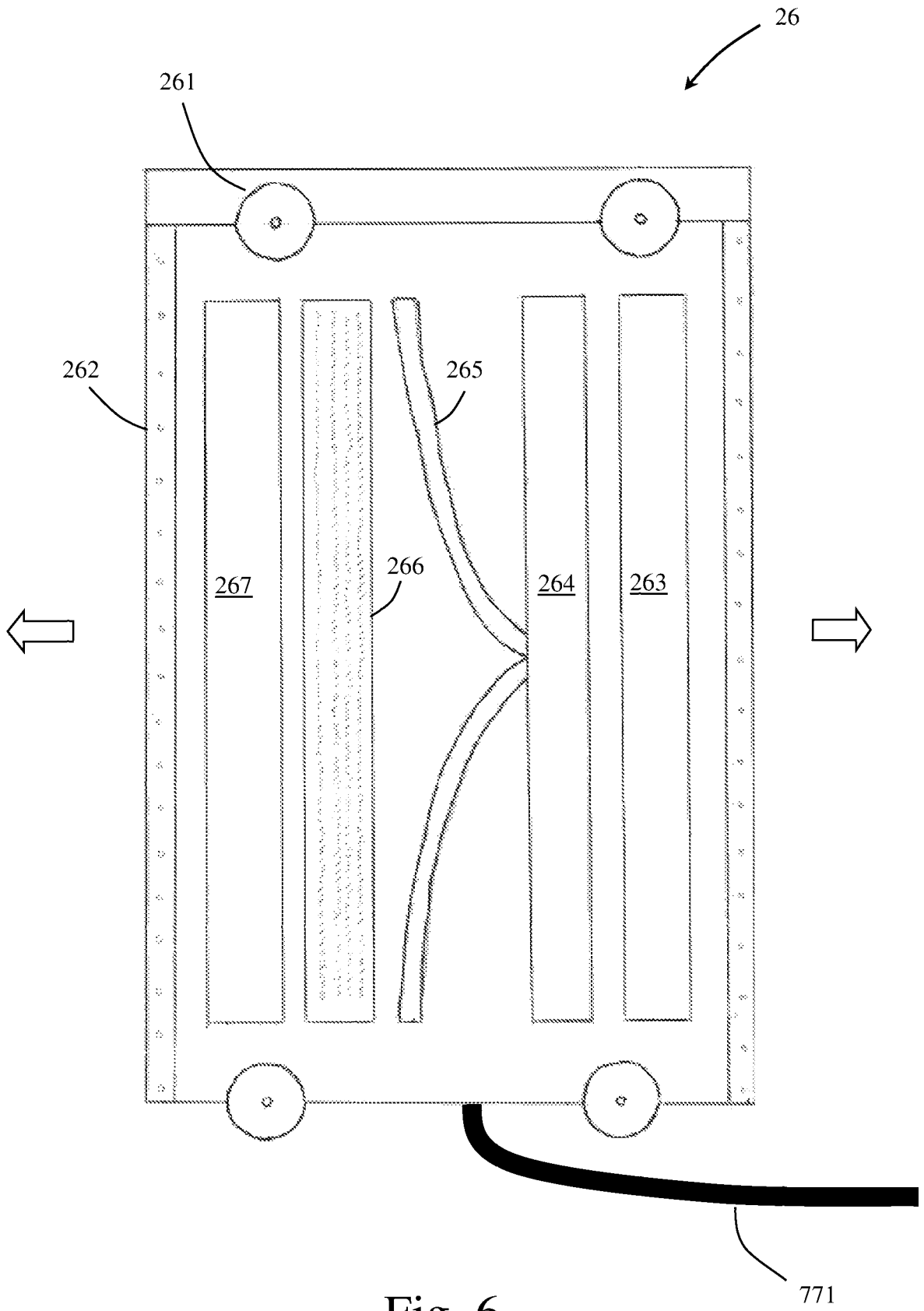
FIG. 6 schematically shows an embodiment of a cleaning head possibly used in various cleaning system embodiments.

Attention is drawn to FIG. 6 illustrating a bottom side of an embodiment of a cleaning head 26 that may be included in any one of the cleaning systems disclosed herein. It is noted that while cleaning head 26 here described is shown including a variety of utilities—embodiments suitable for the present disclosure may vary from the example here shown and/or may include only some of the utilities mentioned.

Cleaning head 26 may be arranged to include utilities such as: wheels 261, sensors 262, dry and/or hot air vents 263, a dirt and water vacuum 264, wipers 265, a brush 266 and a secondary vacuum 267. Cleaning head 26 may be arranged to interact with and clean the floor of a restroom beneath one or more urinals, and may be arranged to receive and/or discharge liquids and/or fluids required or removed during a cleaning operation via suitable conduits from or towards its docking site.

For example, cleaning head 26 may be arranged to receive flexible electrical cables and hydraulic and/or pneumatic hoses required for cleaning actions that it performs (such as drainage, vacuum actions, dirt removal, power and liquid supply, or the like). Such flexible electrical cables and hydraulic and/or pneumatic hoses may be guided via a cable carrier 771 that provides wall-coupling of the cleaning head and extends towards one of the walls of the urinal and/or towards the docking site where the cleaning head is designed to dock when not in use.

The cleaning head may be self-driven via e.g. a motor located within the head. A vacuum engine may be arranged to drain and suck liquids and/or dirt and the brush may also be connected to incoming liquid to enhance cleaning actions for efficient cleaning of the floor.

A controller may be provided within the cleaning head to control all cleaning actions and movements of the cleaning head, such as also sensors or communication with sensors within a cleaning system including cleaning head 26. Possibly, remote control of operations and/or monitoring of cleaning actions performed by the cleaning head may be provided via wire and/or via wireless communication such as via wifi (or the like).

Progress of the cleaning head along a floor being serviced may be along the directions marked by the opposing directed arrows provided in FIG. 6—or along any other suitable direction that may be required.

In at least certain embodiments: fluids, liquids, electrical power (or the like) may be provided for constant operation of the cleaning system and/or head via conduits and/or cables that extend from an upstream source, a rail and/or docking site supporting or housing the cleaning system and/or head. Via such conduits and/or cables provision of power, water, drainage (etc.) may be facilitated. Possibly, such cables may be concealed and substantially not exposed.

Such permanent connection of a cleaning system and/or head to power and water/air conduits may permit heavy duty cleaning and long lasting operation without substantial human interaction. Such permanent connection in the provided example may be provided via the schematically illustrated cable carrier 771.

Figure 7:
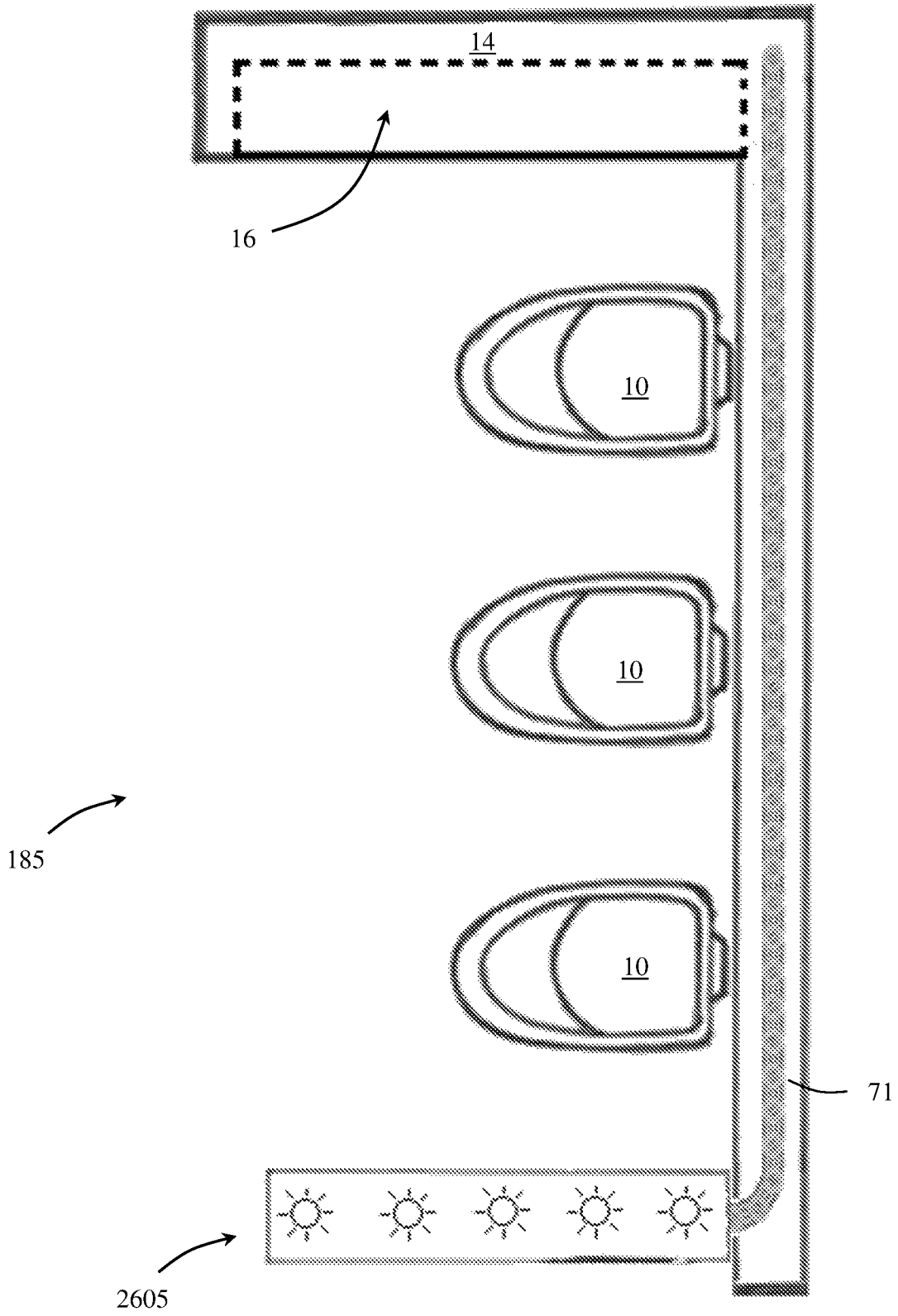
FIG. 7 schematically shows an embodiment of a cleaning system of the present invention.

Attention is drawn to FIG. 7 exemplifying possible provision of conduits and/or cables towards an embodiment of a cleaning system 185 here via a cable carrier 71. Cable carrier 71 may be arranged to at least partially surround and guide flexible electrical cables and hydraulic and/or pneumatic hoses that are connected to the moving cleaning head 2605 of cleaning system 185 during its use.

Cable carrier 71 is here seen optionally extending from adjacent docking site 16 of the cleaning system where the cleaning head may be housed when not in use (while maintained connected to power, water, drainage (or the like)), and may be arranged to permanently connect cleaning system 185 and/or head 2605 to upstream supply and possible drainage sources. In certain embodiments, cable carrier 71 may be arranged to extend alongside a rail that guides the cleaning system and/or head during its operation. Preferably, cable carrier may be substantially concealed e.g. within a wall of the restroom as illustrated.

Figure 8:
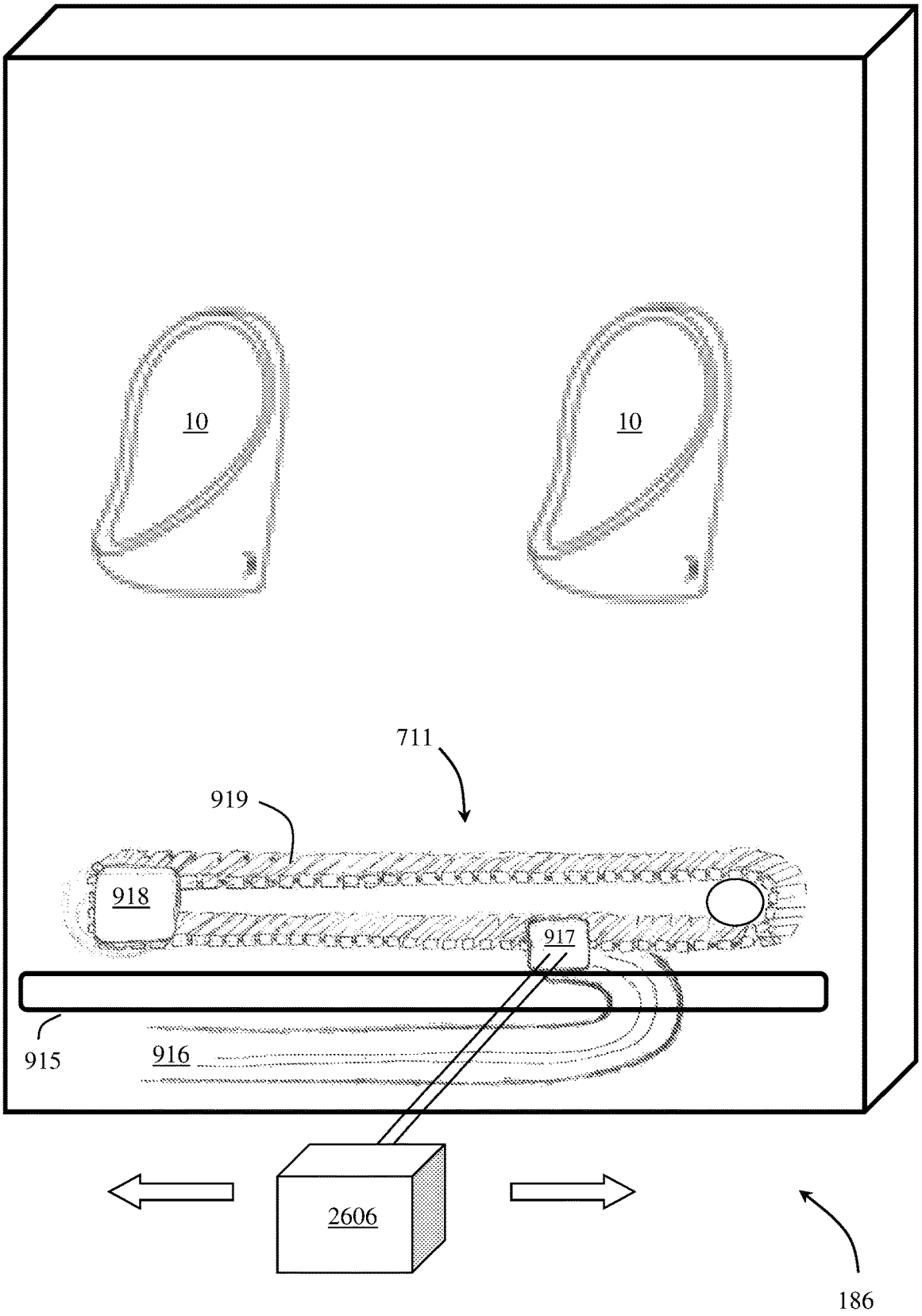
FIG. 8 schematically shows an additional embodiment (generally similar to former ones described) of a cleaning system of the present invention.

Attention is drawn to FIG. 8 for a further view of an embodiment of a cleaning system 186 generally similar to at least some of the former ones discussed herein. Here portions of a cleaning system 186 can be seen concealed within a wall of e.g. a restroom for guiding a cleaning head 2606 that is "so-called" coupled to the wall—to clean a floor located below urinals 10 of the restroom.

The portions here seen within the wall include a cable carrier 711 here including a belt machining 919 that is driven by a motor 918. Attached to the belt machining in this example can be seen a hub 917 that is arranged to be moved by the belt mechanism back and forth along the wall in opposing directions (see arrows) generally parallel to the floor of the restroom.

The hub may be attached to a group of cables 916 located within the wall that may include: liquid, pneumatic, water, fluid, electrical conduits (or the like) required for operation of the cleaning head 2606 of the system. The hub may also be coupled via an opening 915 in the wall (e.g. a slit-like opening)—to the cleaning head for urging movement of the cleaning head along the floor and for coupling/connecting the cleaning head to the group of cables 916.

In the various cleaning system embodiments disclosed herein, docking of a cleaning head of a system may be against the wall and not necessarily within a wall. In addition, docking sites and/or cleaning heads of systems may be provided with a sanitizer/cleaning liquid container for assisting in sanitizing the floor during cleaning or regions within a restroom and/or portions of the cleaning system in between cleaning operations, such as sanitizing a cleaning head of the system in between cleaning operations.

Such systems may also be robotic e.g. without a conveyor belt or actuators for supplying liquids/fluids for performing a cleaning action. Hence such a robotic system may be equipped with internal supplies/resources required for its operation, e.g. water supply, drain container (e.g. for containing used liquid during a cleaning operation), sanitizer container (and the like)—instead of receiving supply of such substance from a conveyor belt. Such robotic systems may in addition be arranged when located within a docking site—to connect to docking ports within or associated with the docking site (e.g. a water source, drainage reservoir, electrical power, etc.) At the docking site the robotic head may be filled automatically with liquids and drain the drain container possibly automatically.

In certain embodiments, cleaning of the system's cleaning head (e.g. brush) may be performed, e.g. with water/sanitizer, when at the docking site—possibly also comprising a step of the drying such cleaning head part.

In at least certain embodiments, a system's cleaning head may include a cleaning member (e.g. brush, mop, or the like) that may be arranged to move during a self-cleaning operation of the cleaning head e.g. against the floor, while being supplied with cleaning substances (e.g. water, sanitizer, etc.). Such self-cleaning of the head's cleaning member may be performed without movement of the cleaning head along the floor (as in a normal cleaning operation). Cleaning substances used during such self-cleaning sequence may be vacuumed to a drain container (or the like).

In certain cases, such self-cleaning procedure may include urging the cleaning member to move against a dedicated rough surface (e.g. with relative sharp projections) aimed for assisting in the cleaning process of the cleaning member.

Figure 9A:
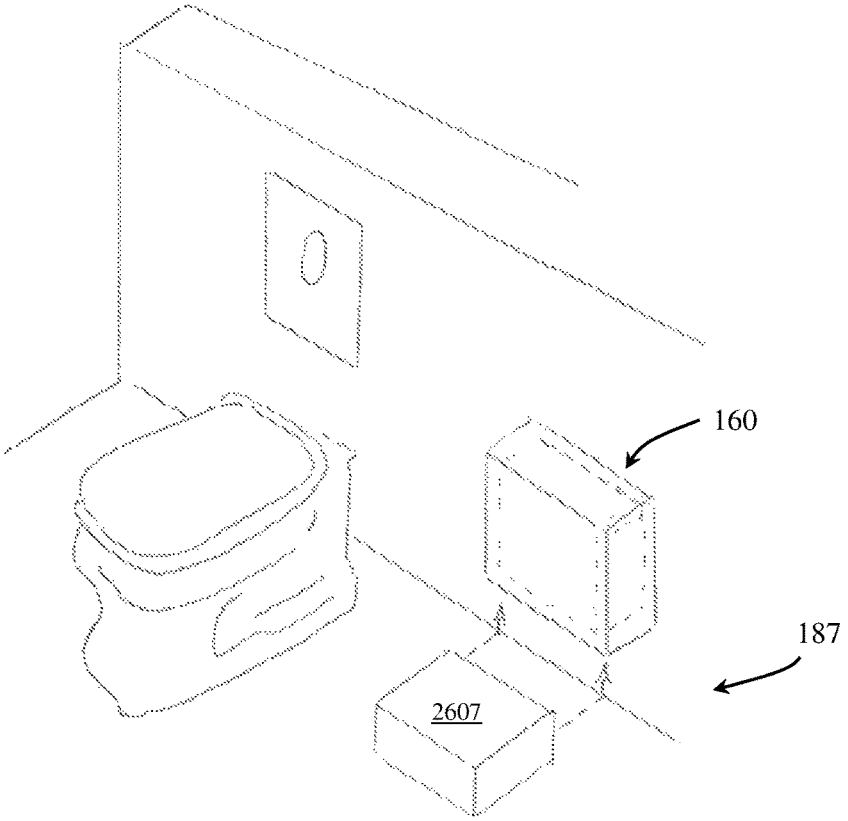
FIGS. 9A and 9B schematically show yet a further embodiment of a cleaning system of the present invention.
Figure 9B:
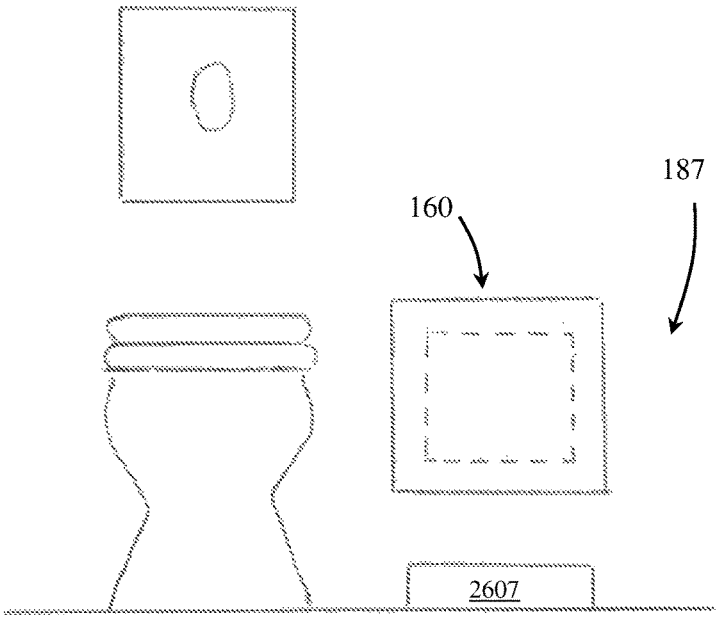

Attention is drawn to FIGS. 9A and 9B schematically illustrating an embodiment of a cleaning system 187 generally similar to the embodiments described herein above, however possibly tailored for restrooms within a dwelling (e.g. a place of residence, home etc.).

Such 'residential' cleaning system 187 may be arranged to cooperate with a docking site inside the wall or a wall mounted docking site 160 as shown (being e.g. parallel to the wall) where the cleaning head 2607 of the system may be stored/parked vertically. Such parking within the docking site may be self-propelled by the cleaning head, which e.g. may self-advance to climb up into the docking site (possibly along a rail provided by the system/docking-site). In certain cases, the docking site may lower an arm member (or the like) aimed at coupling to the cleaning head and lifting same up to the docking site.

Such docking site may be connected to water/power/drain or battery and sanitizer container (or the like)—and/or system's cleaning head may be equipped with small containers that can connect and flush or refill liquids to or from ports the docking site with parked.

Such 'residential' cleaning system may accordingly include many features of system embodiments described herein, such as self-cleaning functionality of a cleaning member (e.g. brush/mop) of the cleaning head.

Figure 10:
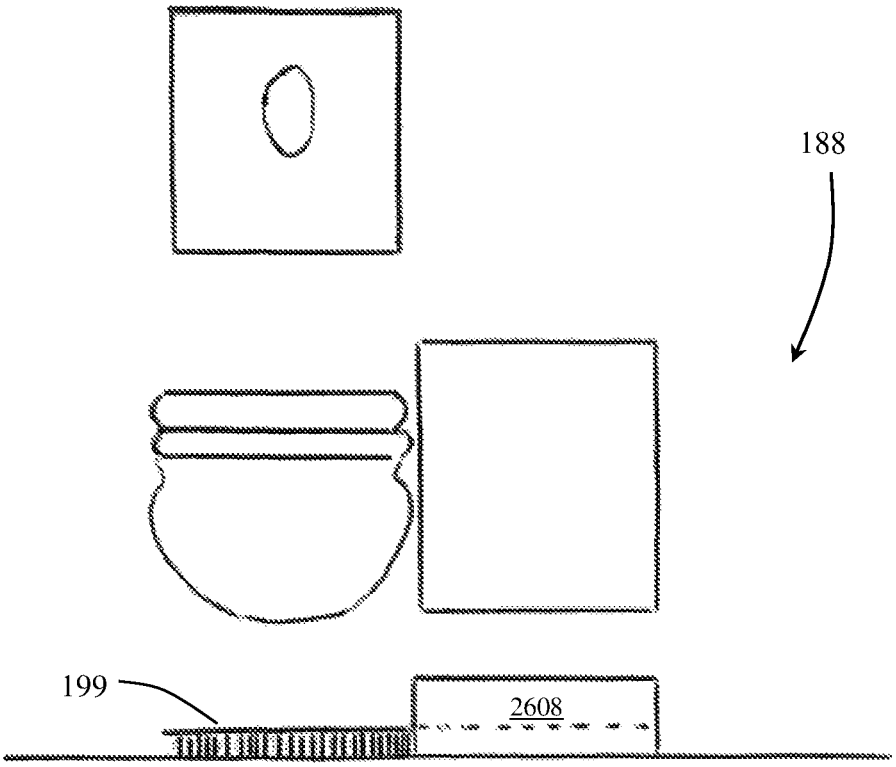
FIG. 10 schematically shows a further embodiment of a cleaning system of the present invention.

Attention is drawn to FIG. 10. In certain embodiments (also applicable to other system embodiments), a cleaning system 188 may be arranged to maneuver a cleaning member 199 of its cleaning head 2608, away from the cleaning head (e.g. sideways)—to access regions where the dimensions of the cleaning head may otherwise permit access. For example, such cleaning member may be urged sideways to clean beneath a toilet cabinet, a toilet bowl (or the like).

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Further more, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A cleaning system for cleaning a floor of a restroom and comprising a wall-coupled cleaning head and a docking site for at least partially housing the cleaning head when not in use, wherein the cleaning head being wall-coupled by being permanently connected to any one of: electrical cables, electrical power, hydraulic and/or pneumatic hoses, hydraulic and/or pneumatic sources, wherein the cleaning head being arranged to communicate with ports of the docking site for receiving and discharging fluids via such ports.

2. The cleaning system of claim 1, wherein the docking site is formed within a wall of the restroom.

3. The cleaning system of claim 2 and being arranged to provide an indication when in use, possibly visual and/or sound indication.

4. The cleaning system of claim 1 and being arranged to clean a floor beneath sanitary fixtures, for example urinals, in the restroom.

5. The cleaning system of claim 4 and being associated with a given sanitary fixture in the restroom to clean the floor only beneath the given fixture.

6. The cleaning system of claim 5, wherein the docking site of the cleaning system is located in the same wall where the sanitary fixture is attached.

7. The cleaning system of claim 6 and being arranged to move in a direction away and towards the docking site to clean the floor beneath the given sanitary fixture.

8. The cleaning system of claim 4, and being arranged to clean the floor beneath all sanitary fixtures in the restroom.

9. The cleaning system of claim 8, wherein the docking site of the cleaning system is located in a wall generally transverse to the wall where the sanitary fixtures are attached.

10. The cleaning system of claim 1 and comprising one or more sensors for detecting presence of substances to be cleaned on the floor.

11. The cleaning system of claim 10, wherein a cleaning action is triggered upon detection of substances by the one or more sensors.

12. The cleaning system of claim 10, wherein at least some sensors are fitted to a sanitary fixture within the restroom and/or to the cleaning head of the system in order to sense presence of substances to be cleaned beneath the sanitary fixture.

13. The cleaning system of claim 1, wherein a cleaning action is triggered periodically.

14. The cleaning system of claim 1, wherein a cleaning action of the cleaning head is performed along a rail of the system, possibly extending along a wall of the restroom.

15. The cleaning system of claim 14 and comprising a cable carrier for least partially surrounding and guiding the electrical cables and hydraulic and/or pneumatic hoses, wherein possibly the cable carrier extends to adjacent the docking site.

16. The cleaning system of claim 1, wherein the cleaning head being self-driven and/or driven to move by an actuator means.

17. A cleaning system for cleaning a floor of a restroom and comprising at least one sensor, a cleaning head and a docking site for at least partially housing the cleaning head when not in use, the cleaning head being arranged to communicate with ports of the docking site for receiving and/or discharging fluids via such ports, wherein the at least one sensor being fitted to a sanitary fixture within the restroom in order to sense presence of substances in proximity to the sanitary fixture, and the cleaning head being controlled to clean the sensed substances in proximity to the sanitary fixture in response detection of such substances by the at least one sensor.

18. The cleaning system of claim 17, wherein the cleaning head comprising internal reservoirs for storing and/or discharging fluids, for example water reservoir, drainage reservoir, sanitizer reservoir.

19. The cleaning system of claim 17, wherein the cleaning head is wall-coupled via conduits to ports in the docking site for receiving and/or discharging fluids via the conduits.

20. The cleaning system of claim 18 and comprising a cleaning member, for example mop or brush, within the cleaning head for being urged to contact the restroom floor during a cleaning process.

21. The cleaning system of claim 20, wherein the cleaning member being movable away from the cleaning head during a cleaning operation.

22. The cleaning system of claim 17, wherein the docking site is located above the floor, possibly attached to a wall of the restroom above the floor, and the cleaning head being arranged to move upwards towards the docking site for its housing within the docking site when not in use.

23. A method for cleaning a floor of a restroom comprising the steps of:

providing a cleaning system comprising a wall-coupled cleaning head and a docking site for at least partially housing the cleaning head when not in use, urging the cleaning head to move and perform a cleaning action of the floor, wherein wall-coupling of the cleaning head is by being permanently connected to electrical cables and hydraulic hoses during movements, wherein the cleaning head being arranged to communicate with ports of the docking site for receiving and discharging liquids via such ports.

24. The method of claim 23, wherein after performing the cleaning action the cleaning head returns towards the docking site.

25. The method of claim 23, wherein after performing the cleaning action the cleaning head at least for a certain time parks not in the docking site.

26. The method of claim 23 and being arranged to provide an indication when in use, possibly visual and/or sound indication.

27. The method of claim 23, wherein the cleaning head being arranged to perform any one of the following actions during a cleaning action: vacuum air and/or liquid, wipe, brush and/or dry the floor being cleaned.

28. The method of claim 23 and comprising one or more sensors for sensing a region to be cleaned, wherein the sensors are located within the restroom and/or on the cleaning head.

29. The method of claim 23 and comprising a controller for controlling at least some operations of the cleaning head, wherein the controller is located within the cleaning head.

30. The method of claim 29 and being arranged to clean a floor beneath sanitary fixtures, for example urinals, in the restroom.

31. The method of claim 23, wherein a cleaning action of the cleaning head is performed along a rail of the system, possibly extending along a wall of the restroom.

32. The method of claim 23 and comprising a cable carrier for least partially surrounding and guiding the electrical cables and hydraulic and/or pneumatic hoses, wherein possibly the cable carrier extends to adjacent the docking site.

* * * * *